United States Patent [19]

Tatge et al.

[11] Patent Number: 4,716,738

[45] Date of Patent: Jan. 5, 1988

[54] APPARATUS AND METHOD FOR DELIVERING CRYOGENIC LIQUID FROM A SUPPLY VESSEL TO RECEIVER VESSELS

[75] Inventors: Robert J. Tatge, Palos Verdes Estates; Thomas E. Pfenning, Newport Beach, both of Calif.

[73] Assignee: CV International, Inc., Torrance, Calif.

[21] Appl. No.: 892,853

[22] Filed: Aug. 4, 1986

[51] Int. Cl.[4] ..... F17C 7/02

[52] U.S. Cl. ..... 62/55; 62/50

[58] Field of Search ..... 62/50, 51, 55

[56] References Cited

U.S. PATENT DOCUMENTS

| | | | |
|---|---|---|---|
| 3,093,974 | 6/1963 | Templer et al. | 62/51 |
| 3,234,745 | 2/1966 | Johnson | 62/50 |
| 3,304,729 | 2/1967 | Chandler et al. | 62/50 |
| 3,433,028 | 3/1969 | Klee | 62/45 |
| 3,633,372 | 1/1972 | Kimmel | 62/49 |
| 3,698,200 | 10/1972 | Johnson et al. | 62/50 |
| 3,699,696 | 10/1972 | Rhoton | 62/50 |
| 3,727,651 | 4/1973 | Biever | 141/231 |
| 4,027,494 | 6/1977 | Fletcher et al. | 62/50 |
| 4,175,395 | 11/1979 | Prost et al. | 62/52 |
| 4,296,610 | 10/1981 | Davis | 62/55 |
| 4,510,760 | 4/1985 | Wieland | 62/51 |

OTHER PUBLICATIONS

CVI, Inc. catalog "Cryogenic Standard Products" cover page and page entitled $LN_2$ Subcooler.

Air Force Technical Manual T.O. 37C2-8-3-13, cover page and pp. 1—1 through 1-5.

*Primary Examiner*—Ronald C. Capossela

*Attorney, Agent, or Firm*—Shapiro and Shapiro

[57] ABSTRACT

Apparatus for delivering cryogenic liquid from a supply vessel to a plurality of receiver vessels employs a subcooler that operates at atmospheric pressure. A supply hose delivers cryogenic liquid from the supply vessel to the subcooler, and coaxial hoses deliver cryogenic liquid from the subcooler to the receiver vessels. The subcooler has an inner chamber surrounded by an annular vent space. A predetermined level of cryogenic liquid is maintained in the inner chamber. Cryogenic vapor from the inner chamber continuously vents to atmosphere via the annular vent space. Cryogenic liquid from the supply hose passes through a heat exchanger in the inner chamber to an inner tube of each coaxial delivery hose, the outer tube of which has one end open to the liquid in the inner chamber and has its other end sealed. The delivery hoses are stored in an upright position, so that the inner and outer tubes thereof become filled with cryogenic vapor under pressure.

11 Claims, 4 Drawing Figures

APPARATUS AND METHOD FOR DELIVERING CRYOGENIC LIQUID FROM A SUPPLY VESSEL TO RECEIVER VESSELS

BACKGROUND OF THE INVENTION

This invention is concerned with the delivery of cryogenic liquids by way of a cryogenic subcooler system.

Cryogens, such as liquid oxygen (LOX), are stored in well-insulated storage vessels, generally at atmospheric pressure. Although the liquid remains at its normal cryogenic temperature, heat leaking into the storage tanks causes product loss through boil-off. Sometimes, if the tanks are not vented, the heat will be retained by the liquid, but with an increase in pressure. The stored heat will be released when the liquid is vented to atmospheric pressure during transfer of the liquid from the storage vessels. Transfer piping, hoses, valves, and other components of the transfer system, when not in use, also absorb a quantity of heat dependent upon the ambient temperature, as may the vessels that are to receive cryogenic liquid from the storage vessels.

When cryogenic liquid is exposed to these warm components, it is heated immediately and begins to boil, i.e., it rapidly changes from a liquid to a vapor. One volume of LOX, for example, expands to 860 volumes of vapor. This phenomenon is a serious obstacle to the efficient transfer of cryogenic liquids from storage vessels, particularly when the transfer of intermittent and at low flow rates. As a liquid, a cryogen may be transferred with ease, but when it "flashes" to vapor, because of the heat in the transfer lines, etc., the extreme change in volume "chokes" the flow. If the choking vapors can be rapidly removed, however, the transfer system can be cooled to cryogenic temperatures rapidly and thus establish liquid flow without boiling.

Liquid cryogen delivery systems have heretofore been proposed that are intended to deliver cryogenic liquids (essentially free of vapor) to a use point intermittently and at low flow rates. One such system is disclosed in U.S. Pat. No. 4,296,610 to Davis, issued Oct. 27, 1981. This sytem employs a technique known as "subcooling", in which a cooling unit is provided adjacent to the use point for not only cooling cryogen so as to condense the vapor but also to further "subcool" the liquid to a temperature at which the equilibrium vapor pressure is less than the pressure of the liquid. The system of the Davis patent employs a subcooler that is an insulated vessel with a heat exchanger therein. Valves are employed to adjust the flow of cryogen from the heat exchanger during offperiods (when no liquid is to be delivered) to a low value just sufficient to completely absorb the heat added through heat leaks downstream of the subcooler, thereby vaporizing the cryogen so that essentially no liquid cryogen reaches the use point, and to adjust the flow to a higher value during on-periods (when delivery of liquid is desired) so that cryogen is delivered to the use point essentially free of vapor.

BRIEF DESCRIPTION OF THE INVENTION

The present invention provides an improved apparatus and method for delivery of cryogenic liquid from a supply vessel, more particularly for intermittent delivery to a plurality of receiver vessels simultaneously and at low flow rates. The present invention employs a unique subcooler that operates at atmospheric pressure and that does not require an insulated vessel. Moreover, the invention does not require an insulated conduit leading to the subcooler from the supply vessel. By virtue of the invention, cryogenic liquid, essentially free of vapor, is delivered quickly and efficiently. The apparatus of the invention is simpler, less expensive, more reliable, and more easily maintained than comparable apparatus of the prior art.

In one of its broader aspects, apparatus for transferring cryogenic liquid from a supply vessel to a receiver vessel in accordance with the invention comprises a double-wall tank defining an inner chamber surrounded by an annular space, inlet means for receiving cryogenic liquid from said supply vessel, means connected to said inlet means for transferring cryogen to said chamber, said annular space communicating with said chamber at an upper region and communicating with the atmosphere at a lower region, whereby cryogenic vapor may vent continuously from said chamber through said annular space to the atmosphere, a heat exchanger disposed in said chamber to transfer heat to cryogenic liquid in said chamber, means connected to said inlet means for transferring cryogenic liquid to said heat exchanger, and at least one delivery hose having one end connnected to said heat exchanger for receiving cooled cryogenic liquid therefrom and having a coupling at an opposite end for delivering the cooled liquid to the receiver vessel.

In another of its broader aspects, a method of transferring cryogenic liquid from a supply vessel to a receiver vessel in accordance with the invention comprises providing a tank having an inner chamber surrounded by an annular spaced, transferring cryogenic liquid from said supply vessel to said inner chamber to provide a cooling bath of cryogenic liquid in said inner chamber, providing a heat exchanger in said cooling bath, inputting cryogenic liquid from said supply vessel to said heat exchanger, outputting cryogenic liquid from said heat exchanger to said receiver vessel, and continuously venting cryogenic vapor from said chamber to said annular space and from said annular space to the atmosphere.

The invention will be further described in conjunction with the accompanying drawings, which illustrate a preferred (best mode) embodiment.

DETAILED DESCRIPTION OF THE INVENTION

Figure 1:
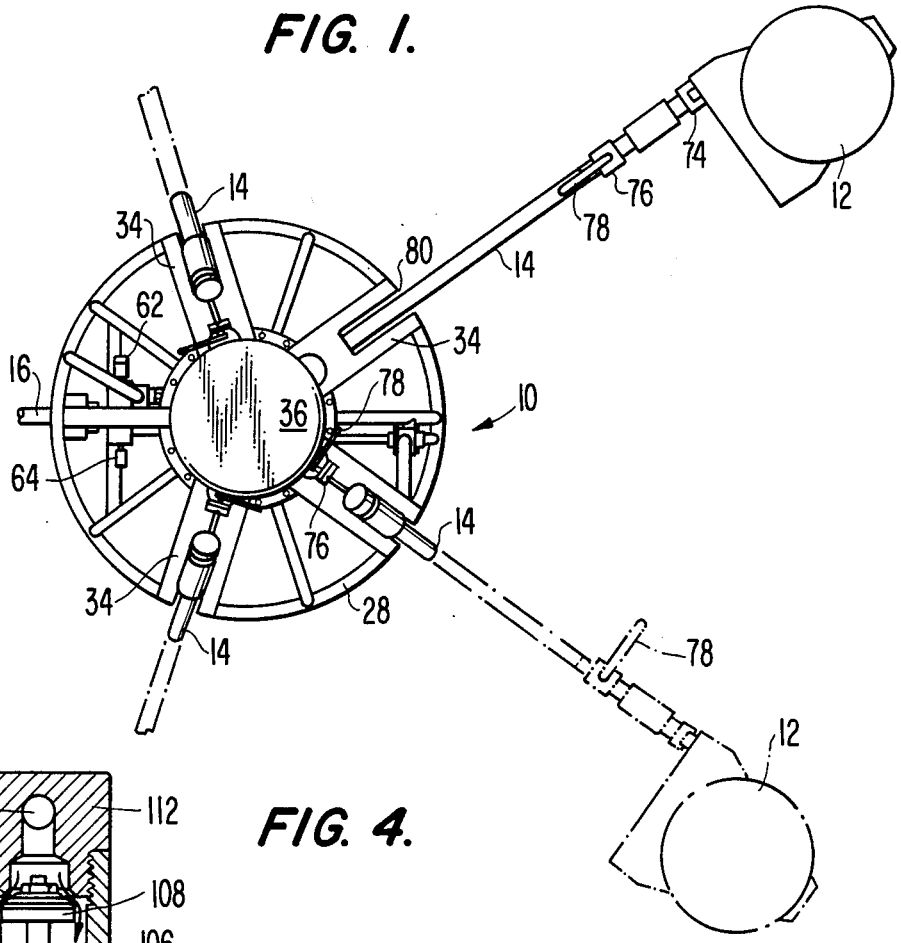
FIG. 1 is a top plan view illustrating a subcooler employed in the invention and a plurality of delivery hoses, one of which is shown extended to a receiver vessel.

Although the invention has broader utility, it will be described in its application to a multiple service unit for transferring LOX from cryogenic storage vessels, such as large storage tanks (e.g., 400–5,000 gallons) or from small tanks on service carts (e.g., 50 gallons) to aircraft "converters" that convert liquid oxygen to gaseous oxygen that may be breathed by pilots. In the form shown in the drawings, up to four converters may be served simultaneously from a single subcooler. One of the unique features of the invention is that the subcooler does not employ a cryogenic dewar.

In the plan view of FIG. 1, a subcooler 10 of the invention is shown delivering cryogenic liuqid to a receiver vessel 12 (e.g., a "converter") via a coaxial delivery hose 14. Other such hoses are shown in their stored position. Cryogenic liquid is supplied to the subcooler 10 from a supply vessel (not shown) via a supply hose 16, which may be uninsulated.

Figure 2:
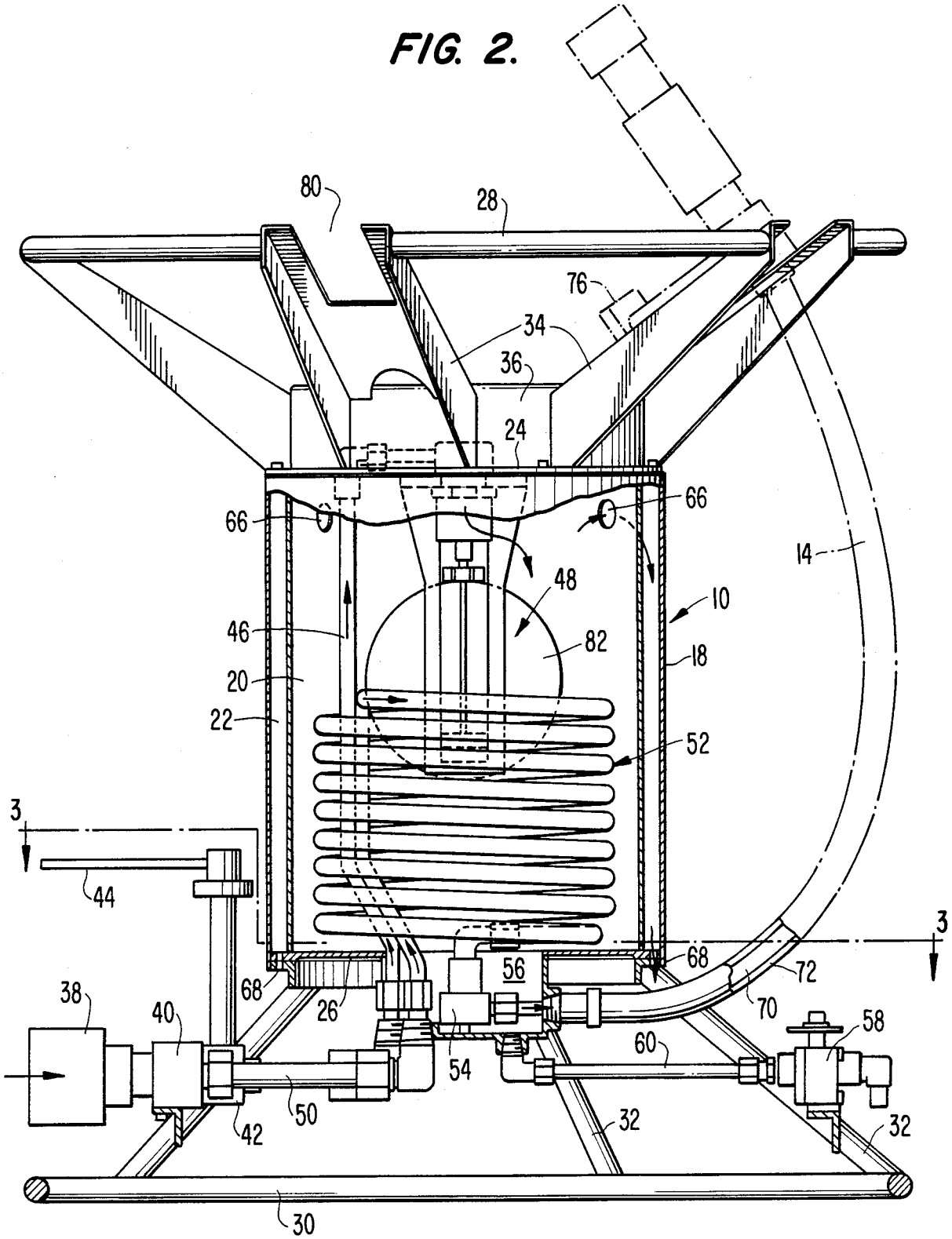
FIG. 2 is a vertical sectional view of the subcooler, with one of the delivery hoses shown in phantom lines in a stored position.

As shown in FIG. 2, the subcooler 10 comprises a double-walled tank 18 defining an inner chamber 20 and an outer annular vent space 22. The tank is closed at the top by a top wall 24 and at the bottom by a bottom wall 26. The subcooler has a superstructure that includes a ring 28 and a substructure or base that includes a ring 30. Ring 30 supports the tank 18 by means of a plurality of downwardly and outwardly inclined rods 32. Ring 28, which is formed in sections, is supported on the tank by means of a plurality of upwardly and outwardly inclined channel-piece arms 34 that constitute holders for corresponding delivery hoses 14 in their stored position, as will be described more fully hereinafter. Arms 34 radiate from a dome 36 that is part of top wall 24.

Figure 3:
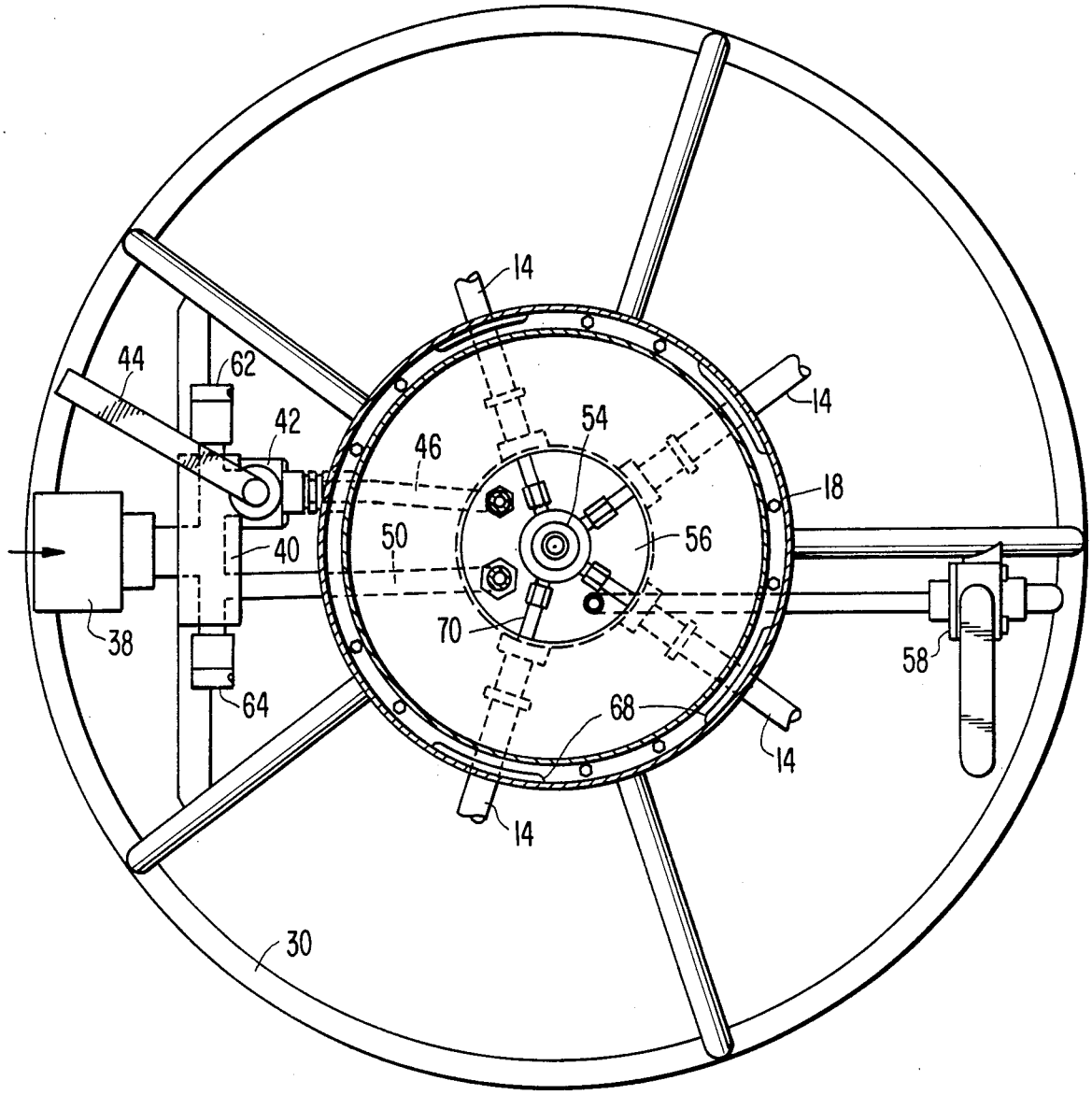
FIG. 3 is a sectional view taken along line 3—3 of FIG. 2.

The supply hose 16 is connected to the subcooler 10 by an inlet coupling 38 connected to a splitter 40, one branch of which has a manually controlled tank valve 42 actuated by a handle 44. Valve 42 controls the flow to a pipe 46 that supplies cryogenic liquid to the inner chamber 20 of tank 18 via a float controlled valve assembly 48, which will be described later. Another branch of the splitter is connected to a pipe 50 that is connected to the inlet of a heat exchanger 52 in the inner chamber 20. The heat exchanger may be comprised of helical tubing. The outlet of the heat exchanger is connected to a manifold 54 at the bottom of the tank, which delivers subcooled liquid to a central tube 70 of each of the coaxial delivery hoses 14. A well 56 at the bottom of the inner chamber 20 is connected to an outer tube 72 of each of the coaxial delivery hoses 14, and also to a manually actuated drain valve 58 by a pipe 60. As shown in FIG. 3, further branches of the splitter 40 are connected to a safety head 62 and a pressure relief valve 64.

As later described, the inner chamber 20 of tank 18 is filled with cryogenic liquid to a predetermined level that is maintained by the float controlled valve assembly 48, by which the heat exchanger 52 is maintained immersed in a cryogenic liquid cold bath. The vapor which forms above the liquid is vented to atmosphere via the annular vent space 22, which communicates with the inner chamber 20 through vent holes 66 at an upper region and communicates with the atmosphere through a plurality of vent holes 68 at the bottom.

At its delivery end, each delivery hose 14 has a quick-disconnect coupling 74 preceded by a manually actuated fill valve 76 that controls the flow of cryogen from the central tube 70. Each fill valve has an operating handle 78. In FIG. 1 the handle 78 is shown in its flow (on) position in solid lines and in its non-flow (off) position in phantom lines. The outer tube 72 of each delivery hose 14 has a dead end before the coupling 74. The delivery hoses are stored upright, as shown in FIG. 2. Each hose is received in a notch 80 formed in the corresponding arm 34. If the handle 78 is in its flow position, it will interfere with the superstructure and prevent the hose from being stored. In the non-flow position of the handle there is no such interference. Thus the delivery hoses cannot be stored unless the fill valves are off. This is a safety feature.

Figure 4:
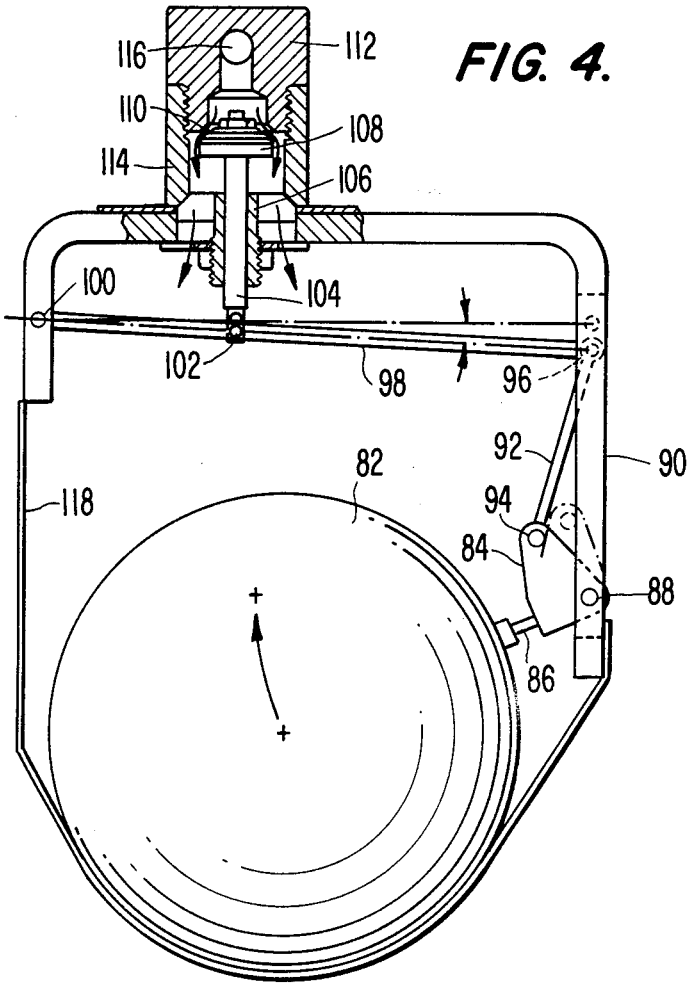
FIG. 4 is a vertical sectional view showing details of a float valve assembly employed in the invention.

A preferred float valve assembly 48 is shown in FIG. 4 and includes a float ball 82 mounted on an arm 84 by means of a short rod 86. Arm 84 is pivotally supported at 88 on a stationary frame 90 that is mounted inside the tank 18. A link 92 has one end pivotally connected at 94 to arm 84 and has its opposite end pivotally connected at 96 to one end of a longer link 98, the opposite end of which is pivoted at 100 on the frame 90. At a point intermediate its ends, link 98 is pivotally connected at 102 (with some freedom for lateral adjustment) to a valve stem 104 that reciprocates in a sleeve 106 and that supports a valve head 108 at its upper end. The valve head is tapered and moves relative to a cooperable tapered seat 110 formed on a plug 112 supported on frame 90 by a sleeve 114. A bore 116 communicates with the inlet pipe 46 (FIG. 2). The downward movement of ball 82 may be limited by a retainer 118 depending from the frame 90 as shown. The mechanism shown in FIG. 4 provides a substantial mechanical advantage for moving the valve head 108 relative to the valve seat 110 in response to movement of the float ball 82.

Operation of the apparatus of the invention and the performance of the method of the invention will now be described. With the subcooler 10 connected to a supply tank (not shown) by the supply hose 16 (the supply tank having been pressurized to 40–50 psi, for example) and with the delivery hoses 14 in the stored position, a fill cycle is initiated by opening a valve at the supply tank and by opening the tank valve 42 at the subcooler. Liquid then enters the warm supply hose 16 from the supply tank and flashes to vapor. With the tank valve 42 open, however, this vapor rapidly vents through the inner chamber 20 and through the outer annular space 22 to ambient. After about one minute of flow, the vapor will sufficiently cool the supply hose and the subcooler piping to initiate flow in liquid form. The presence of liquid accelerates the cooldown process such that after about two minutes, the inner chamber 20 has filled and has covered the heat exchanger 52 with LOX. The float valve assembly 48 will control the liquid level automatically. In addition, liquid also fills the outer tube 72 of each delivery hose 14, which serves to precool these hoses and preclude "flashing" when liquid subsequently flows to the converters 12. The apparatus is now ready for one or more converter fill cycles.

To fill a converter, a delivery hose 14 is withdrawn from its stored position and is purged, before connection to a converter, by rapid opening and closing of its manual fill valve 76. The quick disconnect coupling 74 is a simple type, without a spring-loaded shut-off valve, thereby avoiding a possible icing problem which might cause valve jamming and leakage. Once the coupling 74 is connected to a corresponding converter, LOX is available to the converter upon opening of the manual fill valve 76. The continued supply of liquid (without vapor) at full supply tank pressure serves to rapidly cool down the converter and to accelerate the converter fill.

When the delivery hoses 14 are laid out horizontally in their active position, they present sizable areas which are subject to heat leak (and consequent boil-off loss). When not in use, therefore, these hoses should be stored in their vertical position. In this position the liquid in the inner and outer tubes begins to boil due to heat leak and rapidly pumps down both tubes with vapor, which, in turn, presents a relatively low heat leak path and thus conserves the cryogen in the heat exchanger circuit and reservoir. When the apparatus is operated intermittently, liquid can be further conserved by shutting off the tank valve 42 to avoid maintaining the level of liquid in the chamber 20. With hoses 14 stored vertically, the tank will remain cooled down for at least 15 to 20 minutes, thus minimizing cryogen loss between fills.

Under all operating conditions, except one, the apparatus of the invention is vented to atmosphere, thus precluding any safety problems due to locked-in liquids which could expand and explode. This one condition exists when the supply tank valve is closed, the tank valve 42 is closed, and all four fill valves 76 are closed. In this condition, safety is provided by the pressure relief valve 64, which may be set for relief at a compatible transfer system pressure range, and by the safety head 62, which may be set to open at a pressure value selected to protect the safety of the operator. For example, the pressure relief valve 64 may be set for relief at 50–55 psig and the safety head 62 may be set to open at 90 psig. If the pressure relief valve opens, it will be reclosed upon the opening of tank valve 42 or a manual fill valve 76. When not operating, the subcooler can be pumped out, as desired, by opening the manual drain valve 58 before disconnecting the subcooler from the supply tank.

The apparatus of the invention has many advantages. The main flow from the storage vessel to the vessels being filled (converters) is subcooled in a cryogenic liquid cold bath whose level is continuously maintained by a simple float valve. No heat sensors, sophisticated automatic flow or level controls, pressure gauges or manual adjustments are required. Since the subcooling bath is operated at atmospheric pressure, safety problems, leakage, and construction costs are reduced. The amount of trapped liquid which is possible (for which safety valve protection is required) is small, being limited to the boundary confines of piping and tubing components, and therefore much safer.

Unlike a subcooling dewar, the subcooler of the invention rapidly vents vapor from the supply hose, which ordinarily chokes the flow, and allows the incoming product to flash to ambient. The rapid venting, in turn, initiates and sustains early liquid flow through the supply hose and into the subcooler. Moreover, since the subcooler vents directly to ambient continuously, adequate flow for filling operations can be maintained even at very low supply tank pressures. The necessity to "pressure build" the supply tank is reduced.

The vented vapor in the annulus surrounding the inner chamber of the subcooler forms a vapor refrigeration shield which intercepts and absorbs ambient heat. This boil-off vapor heat shield around the inner chamber is a relatively efficient insulator and is less costly than dewar vacuum insulation. It requires no maintenance and unlike a dewar, there is no vacuum that can be lost, with resultant impairment of insulation. Thus, the apparatus of the invention is more reliable as well as less costly.

Converters are filled with liquid much more rapidly than with conventional apparatus, because the liquid is maintained in subcooled condition in the coaxial delivery hoses right up to the point of delivery. This reduces the internal generation of vapor in the converter over a longer period of time and precludes boil-off of the filled converter that is caused by flashing of superheated liquid.

While a preferred embodiment of the invention has been shown and described, it will be apparent to those skilled in the art that changes can be made in this embodiment without departing from the principles and spirit of the invention, the scope of which is defined in the appended claims. For example, it will be apparent to those skilled in the art that the invention may employ cryogens other than LOX, such as liquid nitrogen, as used in medical or other environments.

The invention claimed is:

1. Apparatus for transferring cryogenic liquid from a supply vessel to a receiver vessel, comprising a double-wall tank defining an inner chamber surrounded by an annular space, inlet means for receiving cryogenic liquid from said supply vessel, means connected to said inlet means for transferring cryogen to said chamber, said annular space communicating with said chamber at an upper region and communicating with the atmosphere at a lower region, whereby cryogenic vapor may vent continuously from said chamber through said annular space to the atmosphere, a heat exchanger disposed in said chamber to transfer heat to cryogenic liquid in said chamber, means connected to said inlet means for transferring cryogenic liquid to said heat exchanger, and at least one delivery hose having one end connected to said heat exchanger for receiving cooled cryogenic liquid therefrom and having a coupling at an opposite end for deliverying the cooled liquid to the receiver vessel.

2. Apparatus in accordance with claim 1, wherein said delivery hose is a coaxial hose having an inner tube connected to said heat exchanger and an outer tube connected to said chamber for receiving liquid therefrom.

3. Apparatus in accordance with claim 1, wherein said means for transferring cryogenic liquid to said chamber includes a manual control valve connected in series with a liquid level control valve responsive to the level of the liquid in said chamber.

4. Apparatus in accordance with claim 1, wherein said delivery hose has a manual fill valve near said opposite end for controlling the delivery of cryogenic liquid from said delivery hose.

5. Apparatus in accordance with claim 1, further comprising a pressure relief valve connected to said inlet means for relieving pressure above a predetermined level.

6. Apparatus in accordance with claim 1, wherein said tank has a manifold at a lower end thereof and has a plurality of said delivery hoses connected to said manifold for receiving cryogenic liquid therefrom.

7. Apparatus in accordance with claim 6, wherein said tank has a superstructure with a plurality of holders for storing said delivery hoses, respectively, said holders engaging said delivery hoses near their said opposite ends, with the hoses extending upwardly from said manifold to said holders.

8. Apparatus in accordance with claim 7, wherein each of said hoses has a manual fill valve adjacent to its said opposite end for controlling the flow of cryogenic liquid therefrom, each fill valve having a control handle movable between a flow position and a non-flow position, said holders having means for permitting the storing of said delivery hoses only when said handles are in the non-flow position.

9. A method of transferring cryogenic liquid from a supply vessel to a receiver vessel, comprising providing a tank having an inner chamber surrounded by an annular space, transferring cryogenic liquid from said supply vessel to said inner chamber to provide a cooling bath of cryogenic liquid in said inner chamber, providing a heat exchanger in said cooling bath, inputting cryogenic liquid from said supply vessel to said heat exchanger, outputting cryogenic liquid from said heat exchanger to said receiver vessel, and continuously venting cryogenic vapor from said chamber to said annular space and from said annular space to the atmosphere.

10. A method in accordance with claim 9, wherein said cryogenic liquid is transferred from said supply vessel to said chamber and to said heat exchanger through an uninsulated hose and wherein said cryogenic liquid is transferred from said heat exchanger to said receiver vessel through a central tube of a coaxial hose having an outer tube connected at one end to said chamber for receiving liquid therefrom and closed at an opposite end.

11. A method in accordance with claim 10, wherein said delivery hose is first stored in a vertical position with a lower end receiving said cryogenic liquid, whereby cryogenic liquid received in the inner and outer tubes is converted to cryogenic vapor under pressure therein, and wherein said delivery hose is thereafter disposed horizontally for the delivery of cryogenic liquid from the inner tube thereof to said receiver vessel.

* * * * *